US011457299B2

(12) United States Patent
Banter et al.

(10) Patent No.: US 11,457,299 B2
(45) Date of Patent: Sep. 27, 2022

(54) PROTECTION OF INTEGRATED LOW POWER SYSTEM DESIGNED TO MONITOR THE ACOUSTIC ENVIRONMENT

(71) Applicant: W. L. Gore & Associates, Inc., Newark, DE (US)

(72) Inventors: Chad Banter, Newark, DE (US); Mark D. Goodrich, Newark, DE (US)

(73) Assignee: W. L. Gore & Associates, Inc., Newark, DE (US)

( * ) Notice: Subject to any disclaimer, the term of this patent is extended or adjusted under 35 U.S.C. 154(b) by 0 days.

(21) Appl. No.: 17/251,114

(22) PCT Filed: Jun. 18, 2019

(86) PCT No.: PCT/US2019/037707
§ 371 (c)(1),
(2) Date: Dec. 10, 2020

(87) PCT Pub. No.: WO2019/246079
PCT Pub. Date: Dec. 26, 2019

(65) Prior Publication Data

US 2021/0258672 A1 Aug. 19, 2021

Related U.S. Application Data

(60) Provisional application No. 62/686,950, filed on Jun. 19, 2018.

(51) Int. Cl.

| | |
|---|---|
| ***H04R 1/08*** | (2006.01) |
| ***H04R 1/02*** | (2006.01) |
| ***H04R 1/44*** | (2006.01) |

(52) U.S. Cl.
CPC ..... *H04R 1/086* (2013.01); *H04R 1/023* (2013.01); *H04R 1/44* (2013.01); *H04R 2201/029* (2013.01); *H04R 2499/13* (2013.01)

(58) Field of Classification Search
CPC ..... H04R 1/086; H04R 1/023; H04R 1/44; H04R 2201/029; H04R 2499/13
See application file for complete search history.

(56) References Cited

U.S. PATENT DOCUMENTS

| | | | | |
|---|---|---|---|---|
| 6,091,830 | A | 7/2000 | Toki | |
| 8,494,204 | B2 | 7/2013 | Jensen | |
| 2016/0037243 | A1 | 2/2016 | Lippert et al. | |
| 2017/0318396 | A1* | 11/2017 | Brioschi | H04R 31/003 |

(Continued)

FOREIGN PATENT DOCUMENTS

| | | |
|---|---|---|
| EP | 2 566 182 A1 | 3/2013 |
| JP | 10-042017 A | 2/1998 |

(Continued)

OTHER PUBLICATIONS

International Search Report and Written Opinion from International Application No. PCT/US2019/037707 dated Sep. 23, 2019.

*Primary Examiner* — Mark Fischer

(57) ABSTRACT

Various aspects of the present disclosure are directed toward apparatuses, systems and methods that include an acoustic apparatus. The apparatuses, systems and methods may include an acoustic membrane and a protective housing defining an interior space in which the acoustic membrane is received.

14 Claims, 8 Drawing Sheets

(56) References Cited

U.S. PATENT DOCUMENTS

| | | | | |
|---|---|---|---|---|
| 2018/0227655 | A1* | 8/2018 | Yamaguchi | H04R 1/083 |
| 2020/0258329 | A1* | 8/2020 | Tabata | H04R 3/00 |
| 2021/0041767 | A1* | 2/2021 | Owaki | H04N 5/2253 |

FOREIGN PATENT DOCUMENTS

| | | | |
|---|---|---|---|
| JP | 2012-138682 | A | 7/2012 |
| JP | 2016-052027 | A | 4/2016 |
| KR | 10-2016-0070759 | A | 6/2016 |
| KR | 10-2017-0070087 | A | 6/2017 |

* cited by examiner

PROTECTION OF INTEGRATED LOW POWER SYSTEM DESIGNED TO MONITOR THE ACOUSTIC ENVIRONMENT

FIELD

The apparatuses, systems, and methods discussed herein are generally directed toward integrated acoustic or sensor systems. More specifically, the apparatuses, systems, and methods are directed toward integrated acoustic or sensor systems that are integrated external to a vehicle's cabin for communication with the vehicle.

BACKGROUND

Electronic devices may have at least one acoustic transducer to convert electrical signals into sound or vice-versa. Acoustic transducers (or similar sensors) such as microphones, loudspeakers, ringers, buzzers, or other devices are placed in a protective housing with one or more small apertures which enable sound signal and reception. These transducers may be covered with an acoustic membrane to help protect the transducer from particulate and or liquid contaminants present in the ambient environment, while facilitating desirable acoustic performance. To preserve acoustic performance of transducers, such membranes must provide minimal sound attenuation. These membranes, may ultimately be relatively fragile due to the acoustic performance requirements.

It is the aim of this disclosure to provide for improvements that facilitate the use of such membranes under demanding ambient conditions.

SUMMARY

According to one example ("Example 1"), an acoustic apparatus includes an acoustic membrane; and a protective housing defining an interior space in which the acoustic membrane is received, the protective housing including indirect pathways extending from outside the protective housing into the interior space of the protective housing to allow acoustic energy from outside the protective housing into the interior space and to the membrane and configured to have a 0.5 dB-20 dB insertion loss in the frequency range from 300 Hz to 5 kHz.

According to another example ("Example 2"), further to the apparatus of Example 1, the apparatus further includes a microphone configured with the acoustic membrane to sense an acoustic signal and arranged within the interior space, and wherein the protective housing defines the interior space in which the microphone and the acoustic membrane are received such hat the acoustic membrane protects the microphone from exposure to water.

According to another example ("Example 3"), further to the apparatus of any one of Examples 1-2, the protective housing includes an upper protective housing and a lower protective housing and the acoustic membrane is arranged between the upper protective housing and the lower protective housing and the microphone is arranged within the lower protective housing and the upper protective housing includes one or more openings along an external surface and one or more vanes aligned with the one or more openings with the one or more vanes configured to direct the water spray away from the membrane.

According to another example ("Example 4"), further to the apparatus of Example 3, the one or more vanes include a curved surface facing the one or more openings and second and third surfaces extending from the curved surface expanding a width of the one or more vanes.

According to another example ("Example 5"), further to the apparatus of any one of Examples 3-4, the protective housing includes protective structure that is at least one of wrapped about the external surface of the protective housing and arranged within the interior space of the protective housing, the protective structure being configured to enhance at least one of wind noise and spray protection performance.

According to another example ("Example 6"), further to the apparatus of any one of Examples 1-5, the upper protective housing and the lower protective housing are configured to interface, and the lower protective housing includes one or more lower openings that are aligned with the openings in the upper protective housing.

According to another example ("Example 7"), further to the apparatus of Example 6, a first surface of the one or more vanes interfaces with a first surface of the lower protective housing.

According to another example ("Example 8"), further to the apparatus of Example 7, the first surface of the one or more vanes interfaces includes a recessed portion relative to the first surface, and the first surface is configured to bound the acoustic membrane.

According to another example ("Example 19"), further to the apparatus of Example 8, the first surface of the lower protective housing includes a first recessed portion and a second recessed portion, and the first recessed portion of the lower protective housing is configured to bound the first surface of the one or more vanes and the second recessed portion of the lower protective housing is configured to bound the acoustic membrane.

According to another example ("Example 10"), further to the apparatus of any one of Examples 2-9, the microphone is a microelectromechanical systems (MEMS) microphone coupled to a flex circuit arranged within the protective housing.

According to another example ("Example 11"), further to the apparatus of Example 10, the protective housing includes an acoustic gap between the microelectromechanical systems (MEMS) microphone and the acoustic membrane.

According to another example ("Example 12"), further to the apparatus of any one of Examples 1-11, the protective housing is configured to exhibit a 0.5 dB-3 dB insertion loss in the frequency range from 300 Hz to 5 kHz.

According to another example ("Example 13"), further to the apparatus of any one of Examples 2-12, the protective housing is arranged external to a cabin of a vehicle; and the microphone is configured to facilitate interaction with the vehicle.

According to one example ("Example 14"), a method of forming an acoustic apparatus includes forming a protective housing including indirect pathways extending from outside the protective housing into an interior space of the protective housing to allow acoustic energy from outside the protective housing into the interior space; and arranging an acoustic membrane within the interior space.

According to another example ("Example 15"), further to the method of Example 14, the method also includes arranging a microphone within the interior space of the protective housing, wherein the protective housing defines the interior space in which the microphone and the acoustic membrane are received such that the acoustic membrane protects the microphone from exposure to water.

According to one example ("Example 16"), an acoustic-transmissive protective apparatus that includes: an acoustic membrane; an electronic component configured with the acoustic membrane to sense an acoustic signal; and a protective housing arranged about the acoustic membrane and the electronic component, the protective housing and the acoustic membrane configured to have a 0.5 dB-20 dB insertion loss in the frequency range from 300 Hz to 5 kHz.

According to another example ("Example 17"), further to the apparatus of Examples 1 to 16, the protective housing is configured to comply with at least one of: International Standard 20653 or International Standard 16750-4 for road vehicles.

According to another example ("Example 18"), further to the apparatus of Example 16, the protective housing includes one or more indirect pathways configured to protect the membrane and the electronic component from a water spray test.

According to another example ("Example 19"), further to the apparatus of Example 18, the indirect pathways are formed by one or more vanes arranged in the housing configured to deflect environmental elements.

According to another example ("Example 20"), further to the apparatus of Example 9, the protective housing includes an upper protective housing and a lower protective housing and the acoustic membrane is arranged between the upper protective housing and the lower protective housing and the microphone is arranged within the lower protective housing.

According to one example ("Example 21"), an acoustic apparatus includes an acoustic membrane; an electronic element configured with the acoustic membrane to sense an acoustic signal; and a protective housing defining an interior space in which the electronic element and the acoustic membrane are received, the protective housing including: one or more openings one or more vanes configured to pass the acoustic energy and environmental elements to the interior space in the protective housing, and one or more vanes arranged within the protective housing and between the one or more openings and the interior space and configured to reduce exposure of the acoustic membrane to direct, pressurized impact of environmental elements.

According to another example ("Example 22"), further to the apparatus of Example 3, each of the one or more vanes includes linear surfaces.

According to one example ("Example 23"), an acoustic apparatus includes an acoustic membrane; and a protective housing defining an interior space in which the acoustic membrane is received, the protective housing including indirect pathways extending from outside the protective housing into the interior space of the protective housing to allow acoustic energy from outside the protective housing into the interior space and to the membrane and configured to have a 0.5 dB-20 dB insertion loss in the frequency range from 300 Hz to 10 kHz.

According to another example ("Example 24"), further to the apparatus of any one of Example 23, the protective housing is configured to exhibit a 0.5 dB-3 dB insertion loss in the frequency range from 300 Hz to 10 kHz.

According to one example ("Example 25"), an acoustic-transmissive protective apparatus that includes: an acoustic membrane; an electronic component configured with the acoustic membrane to sense an acoustic signal; and a protective housing arranged about the acoustic membrane and the electronic component, the protective housing and the acoustic membrane configured to have a 0.5 dB-20 dB insertion loss in the frequency range from 300 Hz to 10 kHz.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the disclosure.

DETAILED DESCRIPTION

Figure 1:
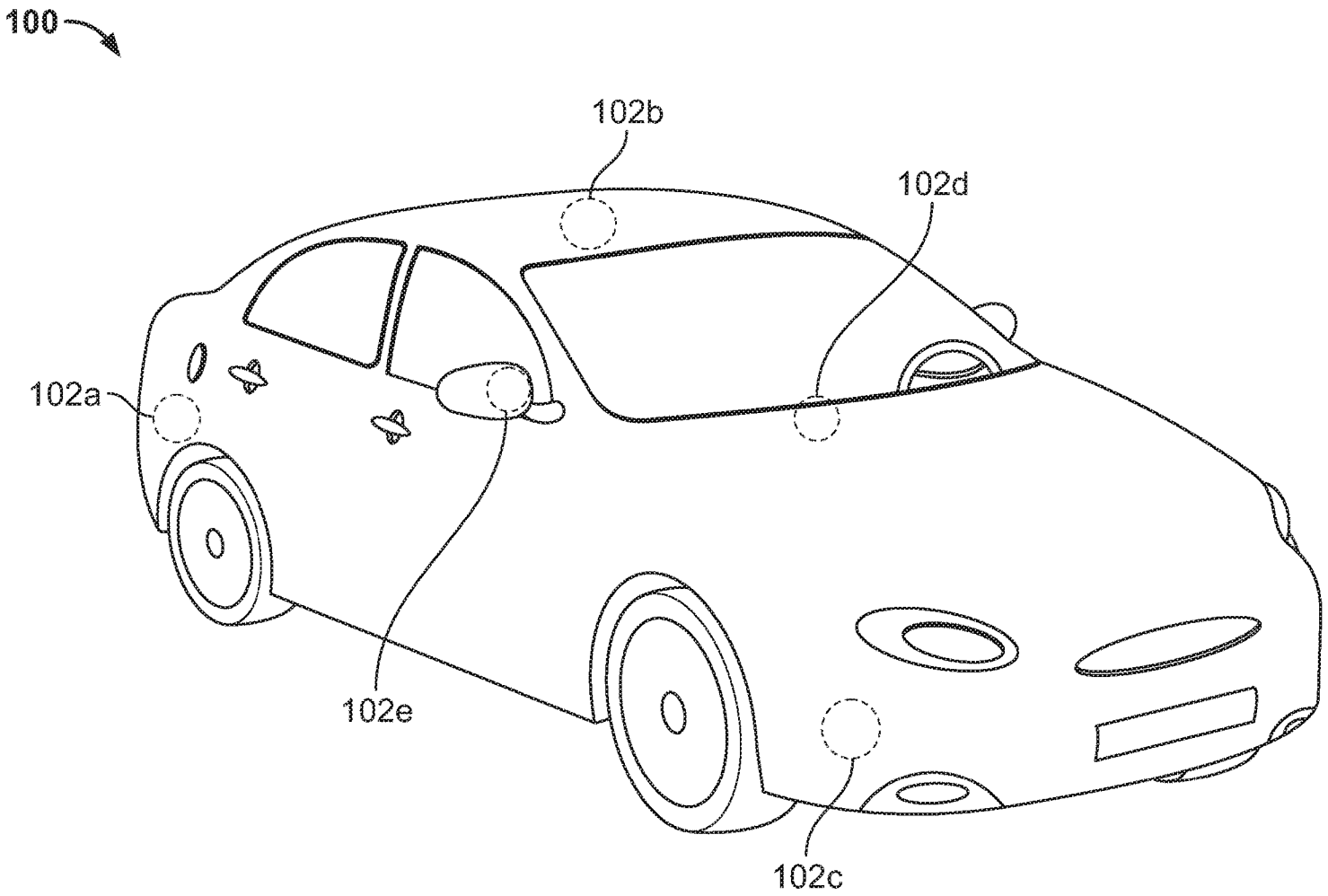
FIG. 1 shows a vehicle with potential sensor/microphone locations in accordance with an embodiment.

Persons skilled in the art will readily appreciate that various aspects of the present disclosure can be realized by any number of methods and apparatus configured to perform the intended functions. It should also be noted that the accompanying drawing figures referred to herein are not necessarily drawn to scale, but may be exaggerated to illustrate various aspects of the present disclosure, and in that regard, the drawing figures should not be construed as limiting.

Various aspects of the present disclosure are directed toward protective housings that are exposed to more aggressive ambient conditions, such as those experienced on the exterior of vehicles, under extreme weather conditions, or which might otherwise be encountered. The housings may be provided to protect sensors, acoustic transducers, microphones or other electronic elements. The sensors, acoustic transducers, microphones or other electronic elements may be manufactured separately from the protective housings and added to the housing separately. The sensors or acoustic transducers can provide a variety of functions, such as communication with on board electronics. For example, an owner or other individual may wish to issue voice commands or prompts to the vehicle when the owner or other individual is external to the vehicle. This may include commanding or prompting the vehicle to lock, start, or perform another function. In addition, the sensors or acoustic transducers may also sense other sounds external to the vehicle (e.g., emergency vehicle sirens, oncoming traffic).

With the sensors or acoustic transducers being arranged external to the vehicle or otherwise exposed to the elements, the sensors or acoustic transducers require protection from various environmental factors, including high velocity rain and atomized water particles, debris, and other elements. Various examples of protective housings (or acoustic microphone apparatuses) addressed in this disclosure generally protect against elements external to a vehicle without unacceptable degradation of an acquired acoustic signal or pressure. For vehicular use, the sensors or acoustic transducer assemblies may require compliance, or it may simply be desirable that the assemblies comply with certain international standards (e.g., International Standard (ISO) 20653: Road Vehicles—Degrees of Protection (IP Code)—Protection of electrical equipment against foreign objects, water, and access; $2^{nd}$ Edition (2013) and ISO 16750-4: Road vehicles—Environmental conditions and testing for electrical and electronic equipment—Part 4: Climatic loads; $3^{rd}$ Edition (2010)) or country-based standards. ISO 20653 describes various degrees of protection against foreign objects/access and against water (e.g. IPx6K and IPx9K tests). ISO 16750-4 describes potential environmental stresses and specifies tests (e.g., thermal cycling test IEC 60068 2-14) and requirements for the specific mounting locations of electronic components with respect to road vehicles to protect the electronic components against climatic loads.

FIG. 1 shows a vehicle 100 with potential sensor/microphone locations 102*a-e* in accordance with an embodiment. As shown in FIG. 1, a sensors or acoustic transducers may be arranged at multiple sensor/microphone locations 102*a-e* external to the vehicle 100. The vehicle 100 may include a single sensor or acoustic transducer at one of the sensor/microphone locations 102*a-e* or the vehicle 100 may include an array or multiple sensors or acoustic transducers at the sensor/microphone locations 102*a-e*. As shown, the sensor/microphone locations 102*a-e* may include portions external to the vehicle including locations such as wind shield wiper compartments, side mirrors, bumpers, wheel wells, and other locations not explicitly shown.

In addition, sensors or acoustic transducers may be arranged at locations external to the vehicle 100 other than the sensor/microphone locations 102*a-e* shown. The sensors or acoustic transducers may be arranged within a housing, which is arranged within an external portion of the vehicle 100 or a portion of the vehicle 100 likely to be exposed to the elements. The housings (not shown) may be arranged such that an external surface of the housing is flush or even with an external or other surface of the vehicle 100.

Figure 2:
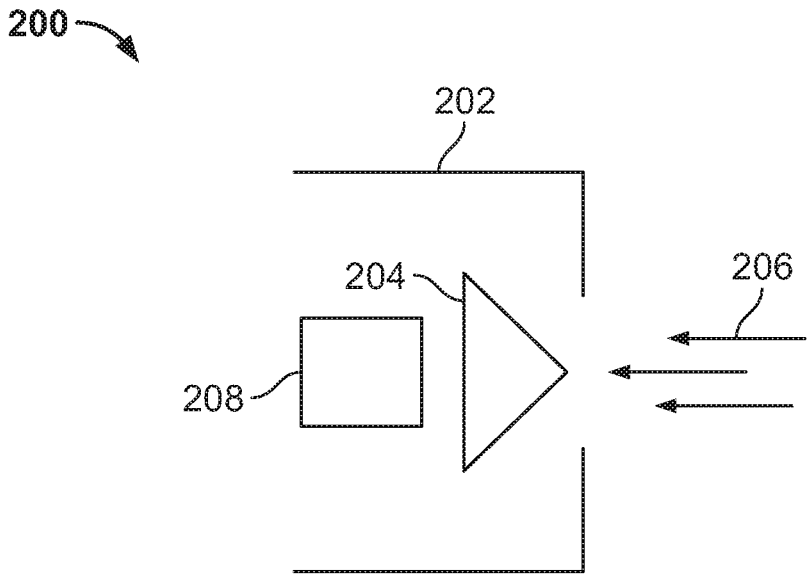
FIG. 2 shows an example acoustic apparatus in accordance with an embodiment.

FIG. 2 is a schematic representation showing an acoustic apparatus 200, that is illustrative of various inventive principles. As indicated, the acoustic apparatus 200 includes a housing 202 that is configured to enclose, house, and protect an acoustic transducer or sensor 208. The acoustic apparatus 200 includes a vane 204 arranged at least partially internal to the housing 202 which forms one or more indirect pathways for flow 206 of ambient air to the transducer or sensor 208. The vane 204 may include portions that are external to the housing 202 or, as shown in FIG. 2, the vane 204 may be arranged entirely within the housing 202. The vane 204 and the housing 202 are configured to protect the acoustic transducer or sensor 208 from environmental elements (e.g., wind noise, water particles, dust, or debris) without unacceptable degradation of acoustic pressure or other sensor signal.

The vane 204, which may be an integral part of the housing 202, forms an indirect pathway for flow 206 of environmental elements. In certain instances, the indirect pathway formed by the vane 204 (and housing 202) lessens the opportunity for elements to impair the functionality of the acoustic transducer or sensor 208 by impinging on a membrane and/or the transducer or sensor 208. The vane 204 (and housing 202) may be configured to protect the acoustic transducer or sensor 208 from a water spray test and allow the acoustic signal to excite the acoustic transducer or sensor 208 without noticeable degradation of the acoustic signal. The material of the vane 204 may be altered or tailored to a use or location (e.g., external to a vehicle) to enhance or improve noise performance.

As shown in FIG. 2, the housing 202 and the vane 204 may have different shapes or arrangements that provide indirect pathways. In addition, the housing 202 and may include multiple vanes 204 as described in further detail below. Further, the housing 202 may be formed in multiple portions with the vane 204 or vanes 204 being formed in one or more portions of the housing 202.

The acoustic apparatus 200 shown in FIG. 2 is provided as an example of the various features of the acoustic apparatus 200 and, although the combination of those illustrated features is clearly within the scope of invention, that example and its illustration is not meant to suggest the inventive concepts provided herein are limited from fewer features, additional features, or alternative features to one or more of those features shown in FIG. 2. For example, in various embodiments, the vane 204 of the acoustic apparatus 200 shown in FIG. 2 may include additional vanes 204 as described with reference to FIGS. 3-6. It should also be understood that the reverse is true as well. One or more of the components depicted in FIGS. 3-6 can be employed in addition to, or as an alternative to components depicted in FIG. 2. For example, the housing 202 of the acoustic apparatus 200 shown in FIG. 2 may be employed in connection with upper/lower protective housings shown in FIGS. 3-6. In certain instances, multiple layers of sensors may be included within the upper/lower protective housings.

Figure 3:
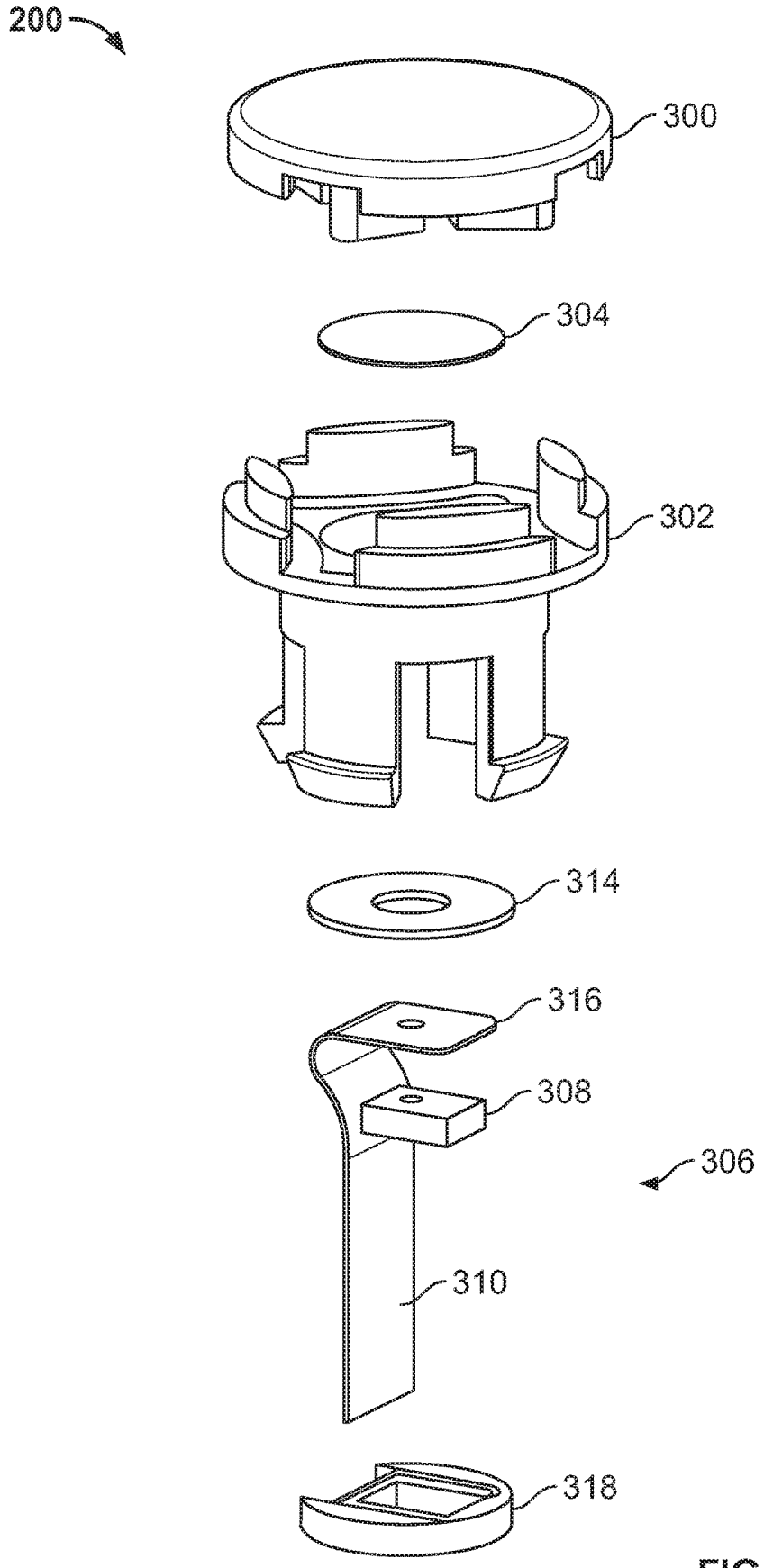
FIG. 3 shows an exploded view of another example acoustic apparatus in accordance with an embodiment.

FIG. 3 shows an exploded view of another example acoustic apparatus 200 in accordance with an embodiment. The acoustic apparatus 200 shown in FIG. 3 may be an acoustic microphone apparatus. In other instances, the acoustic apparatus may be a sensor apparatus, an acoustic sensor apparatus, or other apparatuses configured to protect components arranged therein. As shown in FIG. 3, the apparatus 200 includes a protective housing 300, 302. As noted above with reference to FIG. 2, the protective housing 300, 302 may be formed of a single component and as shown in FIG. 3, the protective housing 300, 302 may be formed of multiple components.

The acoustic apparatus 200 may also include an acoustic membrane 304 and an electronic component 306 (e.g., a microphone, sensor). The electronic component 306 configured with the acoustic membrane 304 to sense an acoustic signal. The protective housing 300, 302 is configured to protect the membrane 304 and electronic component 306 from a water spray test (International Standard (ISO) 20653: Road Vehicles—Degrees of Protection (IP Code)—Protection of electrical equipment against foreign objects, water, and access or other country-based standards). The protective housing 300, 302 is also configured to form an acoustic gap providing, in combination with the membrane 304, a desired acoustic performance (e.g., 0.5 dB-20 dB insertion loss in the frequency range from 300 Hz to 5 kHz), as is discussed in further detail with reference to FIGS. 6A-C.

In certain instances, the protective housing 300, 302 may include an upper protective housing 300 and a lower protective housing 302. As shown in FIG. 3, the acoustic membrane 304 is arranged between the upper protective housing 300 and the lower protective housing 302 and may be supported by the lower protective housing 302. In addition, the electronic component 306 may be arranged within the lower protective housing 302, as is discussed in further detail with reference to FIGS. 6A-C. The upper protective housing 300 and the lower protective housing 302 are configured to interface.

In addition, the electronic component 306 may be a microelectromechanical systems (MEMS) microphone 308 coupled to a flex circuit 310 that may be arranged within the protective housing 300, 302. As shown in FIG. 3, the MEMS microphone 308 is arranged in a horizontal orientation relative to a vertical portion of the flex circuit 310. For reference, the terms "vertical" and "horizontal" are relative terms, provided to define the relative orientation of certain features. For example, in certain instances, the flex circuit 310 includes a bend that orients an upper portion 316 of the flex circuit 310 at an angle (e.g., 90 degrees) relative to the remaining portions of the flex circuit 310. The upper portion 316 of the flex circuit 310 is parallel to the MEMS microphone 308. The bend of the flex circuit 310 may facilitate arrangement of the electronic component 306 structure within the lower protective housing 302. In other instances, the flex circuit 310 may be vertically oriented such that no bend exists in the upper portion 316 of the flex circuit 312.

The acoustic apparatus 200 optionally includes a gasket 314 between the lower protective housing 302 and the electronic component 306. In certain instances and in lieu of or in addition to the gasket 314, the electronic component 306 may be adhered to the upper protective housing 300 or the lower protective housing 302. In addition, the upper protective housing 300 and/or the lower protective housing 302 may be overmolded directly to or about the electronic component 306. The gasket 314 may facilitate acoustic performance of the electronic component 306, assist with sealing the microphone 308 against ingress of moisture, aid to prevent vibration or shock damage to the microphone 308, or provide additional or alternative functions as desired. The gasket 314 may be formed of silicone or another similar low durometer material. In addition, the acoustic apparatus 200 may include a base portion 318 that is arranged about the flex circuit 310 below the microphone 308 and attached to the lower protective housing 302. The base portion 318 may be configured to help protect the microphone 308 from the elements, as is discussed in further detail with reference to FIGS. 6A-C.

Figure 4B:
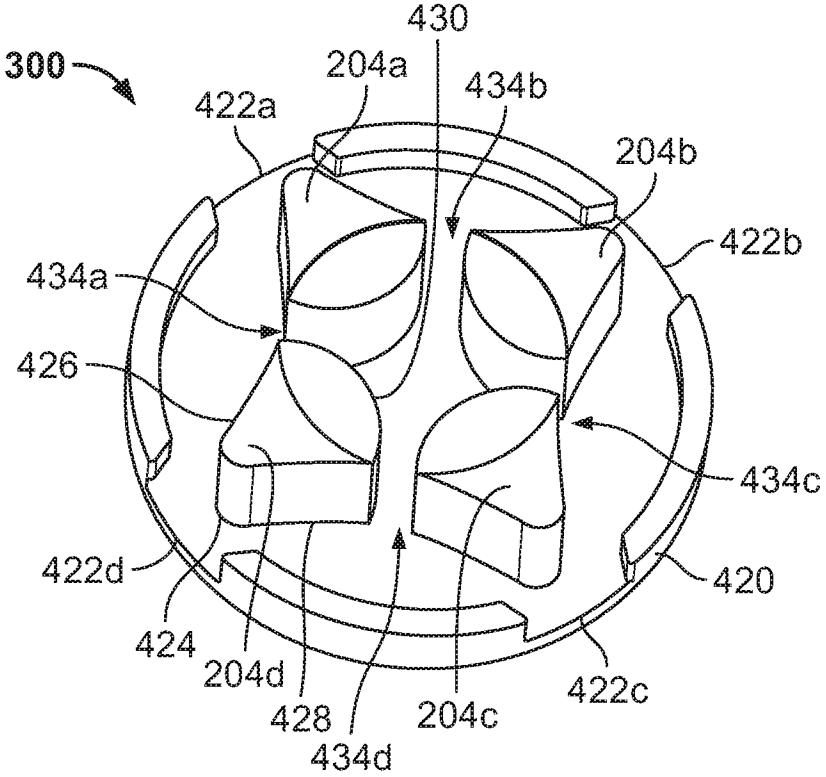
FIG. 4B shows a second perspective view of the upper protective housing, shown in FIG. 4A, in accordance with an embodiment.
Figure 4A:
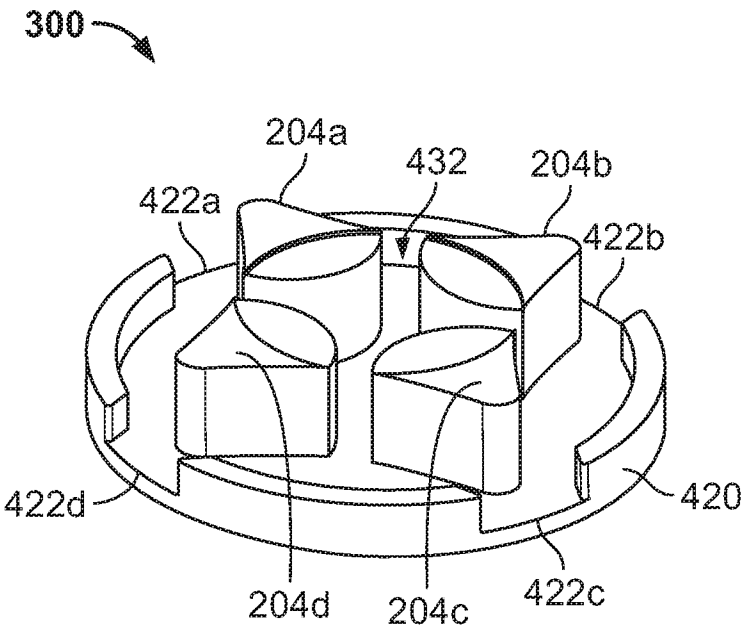
FIG. 4A shows a first perspective view of an upper protective housing of a protective housing in accordance with an embodiment.

FIG. 4A shows a first perspective view of an upper protective housing 300 of a protective housing in accordance with an embodiment. The upper protective housing 300 may include one or more vanes 204*a-d* that are configured to form one or more indirect pathways 452 (shown in FIG. 4C and in further detail with reference to FIG. 6C) to permit signal of acoustic energy into the housing adjacent the acoustic membrane while reducing exposure of the acoustic membrane 304 to direct, pressurized impact of environmental elements (e.g., wind noise, water particles, dust, or debris) for the protection of the acoustic membrane 304 and/or electronic component 306 (or sensor) arranged within the protective housing 300, 302.

As shown in FIG. 4A, the upper protective housing 300 includes four vanes 204*a-d*. In certain instances, the upper protective housing 300 includes a different number of vanes, such as one, two, three, five, six, seven, eight or any other number of vanes 204*a-d*. The vanes 204*a-d* may be formed as integral parts of the upper protective housing 300, or as separate connected components. For example, the vanes 204*a-d* may be foam structures coupled to the upper protective housing 300. In addition, the vanes 204*a-d* may be partially or entirely arranged within the lower protective housing 302. In some instances, portions of the vanes 204*a-d* may be arranged with the upper protective housing 300 and other portions of the vanes 204*a-d* may be arranged with the lower protective housing 302.

As explained in further detail with reference to FIGS. 6A-C, the upper protective housing 300 and the lower protective housing 302 are coupled to one another to form a protective housing 300, 302 for the acoustic apparatus 200. As shown in FIG. 4A, for example, the upper protective housing 300 includes an external surface 420. The lower protective housing 302 also includes a corresponding external surface 546. The vanes 204*a-d* may extend internally relative to the external surface 420 of the (upper) protective housing 300 toward an interior 432 of the (upper) protective housing 300. In instances where there are multiple vanes 204*a-d*, the vanes 204*a-d* may be arranged circumferentially about the interior 432 of the upper protective housing 300.

Indirect pathways 452, formed by the vanes 204*a-d*, for the environmental elements extend from the external surface 420. Openings 422*a-d* in the upper protective housing 300 may be an entry point for the indirect pathways 452 (formed by the housing 300, 302 and the vanes 204*a-d*). The openings 422*a-d* may be equal in number to the vanes 204*a-d*. In addition, the openings 422*a-d* allow for environmental elements and acoustic pressure waves to enter the protective housing 300, 302. In certain instances, the vanes 204*a-d* are aligned with the openings 422*a-d*. The vanes 204*a-d* are configured to direct the environmental elements (e.g., water spray) away from the membrane 304 arranged within the protective housing 300, 302. The vanes 204*a-d* are arranged to prevent direct impingement of environmental elements (e.g., water spray) on the membrane 304. In certain instances, the openings 422*a-d* are the only access point for environmental elements to enter the protective housing 300, 302. Thus, the environmental elements (e.g., water spray, or atomized water particles) directly contact the vanes 204*a-d* upon entry into the protective housing 300, 302. As a result, the elements of the protective housing 300, 302 (e.g., vanes 204*a-d*, openings 422*a-d*) form the indirect pathways 452 (shown in FIG. 4C) for environmental elements (e.g., water spray) while also maintaining an entry point for an acoustic signal to excite the membrane 304 and electronic component 306 as discussed in further detail below.

FIG. 4B shows a second perspective view of the upper protective housing 302, shown in FIG. 4A, in accordance with an embodiment. In certain instances, the vanes 204*a-d* may include a curved surface 424 facing the openings 422*a-d*. In other instances, the vanes 204*a-d* may have linear surfaces (as shown in the non-limiting exemplary embodiment of FIG. 4D), include diagonals, or other shapes. In addition, the vanes 204*a-d* may also include second 426 and third surfaces 428 extending from the curved surface 424 expanding a width of the vanes 204*a-d*. The curved surface 424 and the second 426 and third surfaces 428 are shown on one of the vanes 204*a-d* for ease of illustration. In certain instances, the vanes 204*a-d* may include a fourth surface 430 arranged adjacent the interior 432 of the upper protective housing 300.

In instances where the one or more vanes 204*a-d* includes multiple vanes 204*a-d*, gaps 434*a-d* are between the vanes 204*a-d*. In addition, and as shown in FIG. 4B, the gaps 434*a-d* can be offset from the openings 422*a-d* along the external surface 420. The gaps 434*a-d* allow for an acoustic signal or pressure signal to reach the membrane 304, which is arranged along the interior 432 of the protective housing 300, 302, while maintaining the indirect pathways 452 (shown in FIG. 4C) for environmental elements due to the gaps 434*a-d* being offset from the openings 422*a-d*.

Figure 4C:
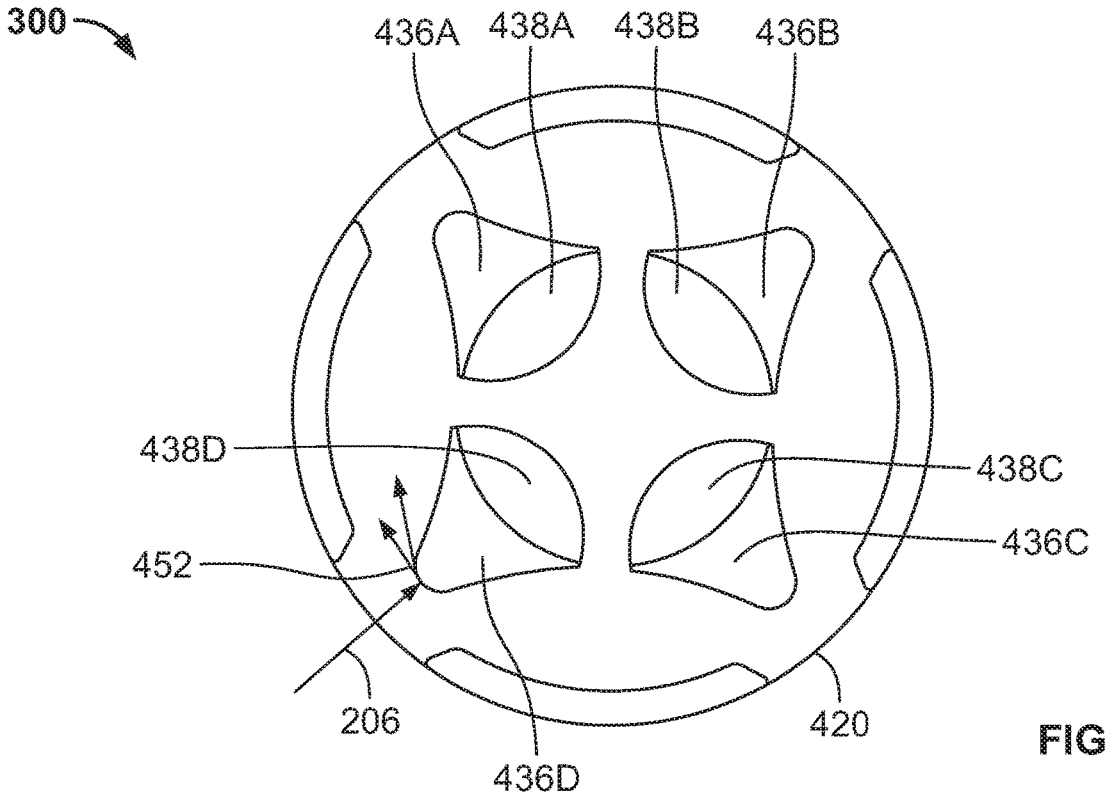
FIG. 4C shows a bottom view of the upper protective housing, shown in FIGS. 4A-B, in accordance with an embodiment.
Figure 4D:
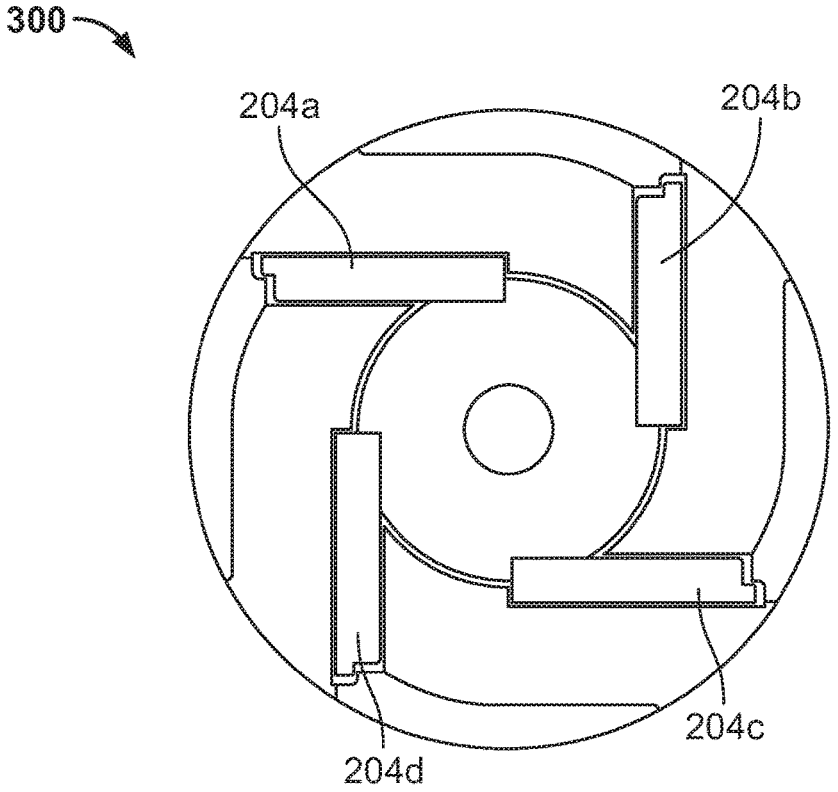
FIG. 4D shows an exemplary embodiment of an upper protective housing having vanes with linear surfaces.

FIG. 4C shows a bottom view of the upper protective housing 302, shown in FIGS. 4A-B, in accordance with an embodiment. As noted above, the membrane 304 is arranged along the interior 432 of the protective housing 300, 302. In certain instances, the membrane 304 is arranged on a first surface 436*a-d* of the vanes 204*a-d*. In other instances, the vanes 204*a-d* may include a recessed portion 438*a-d* relative to the first surface 436*a-d*. To facilitate arrangement of the membrane 304 (not shown in FIGS. 4A-C), the membrane 304 may be arranged on the recessed portion 438*a-d* of the vanes 204*a-d*. As a result, the first surface 436*a-d* may bound the membrane 304. The first surface 436*a-d* and the recessed portion 438*a-d* may additionally protect the membrane 304 from the environmental elements (e.g., wind, water spray, particulate, or other contaminants) and also incidental damage or impingement from the protective housing 300, 302 by having the membrane 304 recessed and not laterally exposed.

An example of flow 206 of environmental elements is shown in FIG. 4C. The protective housing 300, 302 defines an interior space (e.g., gap 660 shown in FIG. 6B) in which the electronic component 306 (e.g., a microphone, sensor) membrane 304 are received. The membrane 304 protects the electronic component 306 (e.g., a microphone, sensor) from exposure to water. In addition, the protective housing 300, 302 including the indirect pathways 452, extending from outside the protective housing into the interior space of the protective housing for signal of acoustic energy from outside the protective housing into the interior space and to the membrane 304. The indirect pathways 452 being configured to protect the membrane 304 and electronic component 306 (e.g., a microphone, sensor) from a ISO 20653 water spray test and allow the acoustic signal to excite the membrane 304 without noticeable degradation of the acoustic signal.

In certain instances, an angle created by the indirect pathways 452 is formed to permit atmospheric and acoustic pressure into the protective housing 300, 302. In addition, the vanes 204*a-d* may be sized to create the indirect pathways 452 to permit atmospheric and acoustic pressure into the protective housing 300, 302 while also protecting the membrane 304 and electronic component 306 from the water and other environmental elements.

Figure 5A:
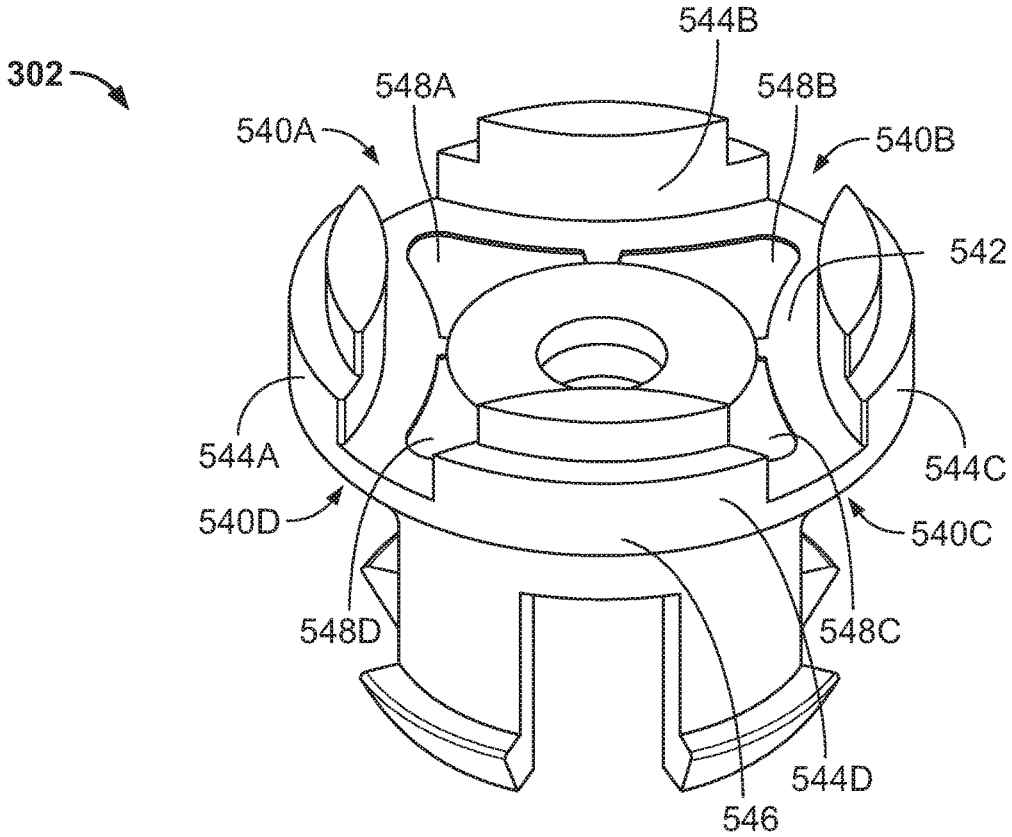
FIG. 5A shows a first perspective view of a lower protective housing in accordance with an embodiment.
Figure 5B:
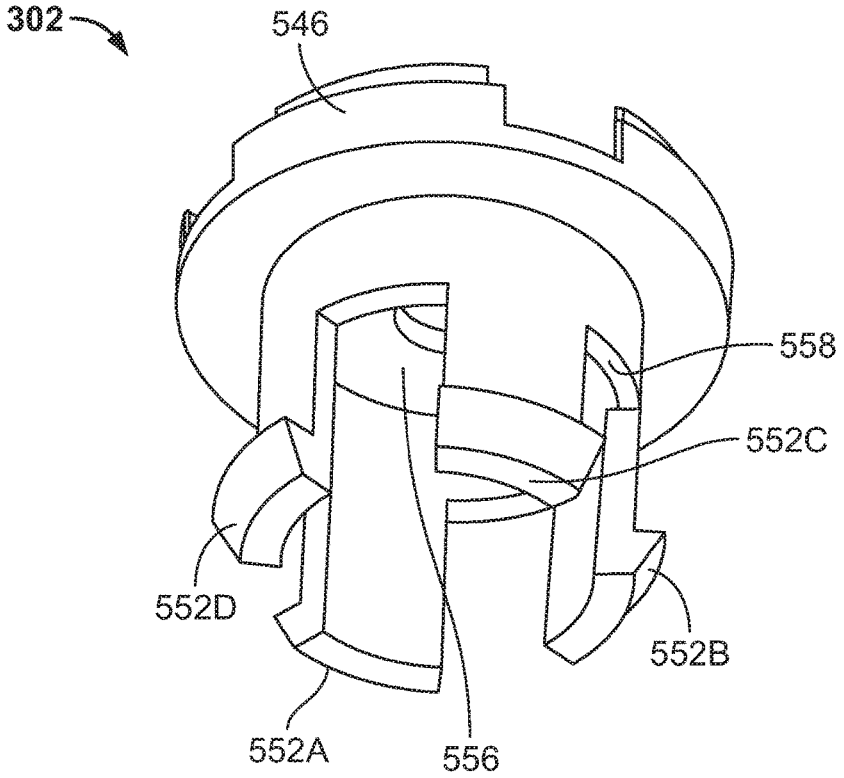
FIG. 5B shows a second perspective view of the lower protective housing, shown in FIG. 5A, in accordance with an embodiment.
Figure 5C:
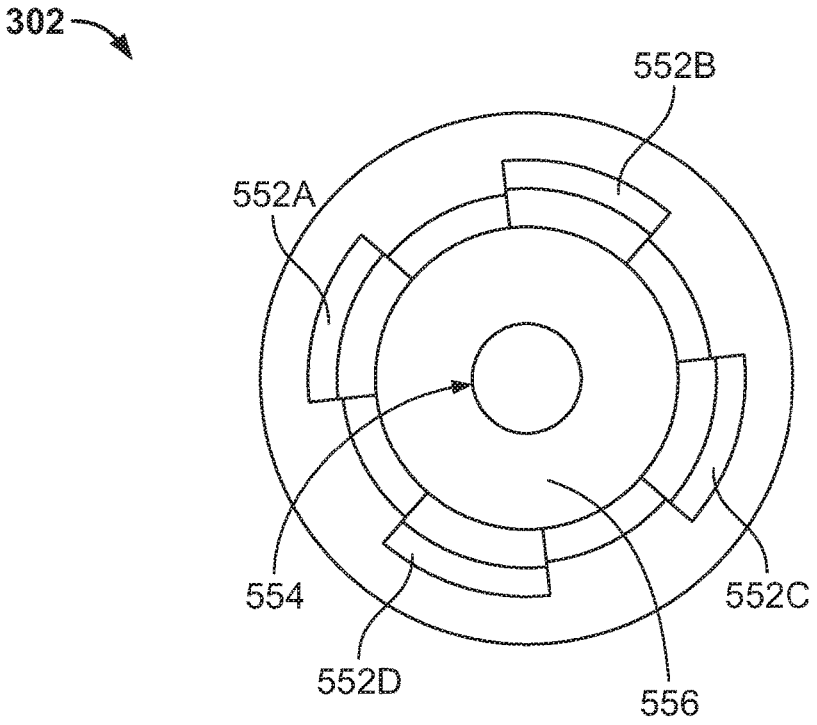
FIG. 5C shows a bottom view of the lower protective housing, shown in FIGS. 5A-B, in accordance with an embodiment.

FIG. 5A shows a first perspective view of a lower protective housing 302 of a protective housing in accordance with an embodiment. The upper protective housing 300, shown in FIGS. 4A-C, and the lower protective housing 302, shown in FIGS. 5A-C are configured to interface. In certain instances, the upper protective housing 300 and the lower protective housing 302 form a protective housing 300, 302.

In certain instances, the lower protective housing 302 includes one or more lower openings 540*a-d*. The lower openings 540*a-d* in the lower protective housing 302 can be aligned with the openings 422*a-d* in the upper protective housing 300. Upon assembly, the sets of openings 422*a-d*, 540*a-d* combine to define openings in the protective housing 300, 302 formed by the integration of the upper protective housing 300 and the lower protective housing 300.

In certain instances, the lower protective housing 302 includes first surface 542. The lower protective housing 302 includes first extensions 544*a-d* extending perpendicular to and from the first surface 542 of the lower protective housing 302. The extensions 544*a-d* are configured to protect the internal elements (e.g., a membrane 304) of the protective housing 300, 302. In addition, the extensions 544*a-d* provide an external surface 546 of the lower protective housing 302 with the lower openings 540*a-d* being through the external surface 546 of the lower protective housing 302.

The first surface 436*a-d* of the vanes 204*a-d* may be configured to interface with the first surface 542 of the lower protective housing 302. In addition, the first surface 542 of the lower protective housing 302 includes a first recessed portion 548*a-d* and a second recessed portion 550. The first recessed portion 548*a-d*, in certain instances, are complimentary to the vanes 204*a-d*. The first recessed portion 548*a-d* bounds the vanes 204*a-d* and may be configured to facilitate integration between the upper protective housing 300 and the lower protective housing 302. In addition, and similar to the recessed portion 438*a-d* of the vanes 204*a-d*, the second recessed portion 550 is configured to bound the membrane 304. The recessed portion 438*a-d* of the vanes 204*a-d* and the second recessed portion 550 may be configured to facilitate protection of the membrane 304 by partially or surrounding the edges of the membrane 304.

FIG. 5B is a second perspective view of the lower protective housing 302, shown in FIG. 5A, in accordance with an embodiment. The lower protective housing 302 includes second extensions 552*a-d*. The second extensions 552*a-d* extend oppositely from the first extensions 544*a-d*. Although four first extensions 544*a-d* and second extensions 552*a-d* are shown, the lower protective housing 302 may include any number (e.g., one, two, three, five, six, seven, eight) and unequal numbers of the first extensions 544*a-d*. The second extensions 552*a-d* are optional features. In instances where the second extensions 552*a-d* are not present, the lower protective housing 302 may stop at surface 558.

The second extensions 552*a-d* surround a second surface 556 of the lower protective housing 302. As discussed in further detail with reference to FIGS. 6A-C, an electronic component 306 may be arranged adjacent to or contact the second surface 556 of the lower protective housing 302. In certain instances, the second extensions 552*a-d* are configured to protect the electronic component 306. Further, an opening 554 may be arranged in the lower protective housing 302.

FIG. 5C shows a bottom view of the lower protective housing 302, shown in FIGS. 5A-B, in accordance with an embodiment. The opening 554 facilitates signal of the acoustic signal or pressure signal between the membrane 304, arranged along the first surface 542 of the lower protective housing 302, and the electronic component 306, arranged along the second surface 556 of the lower protective housing 302.

Figure 6A:
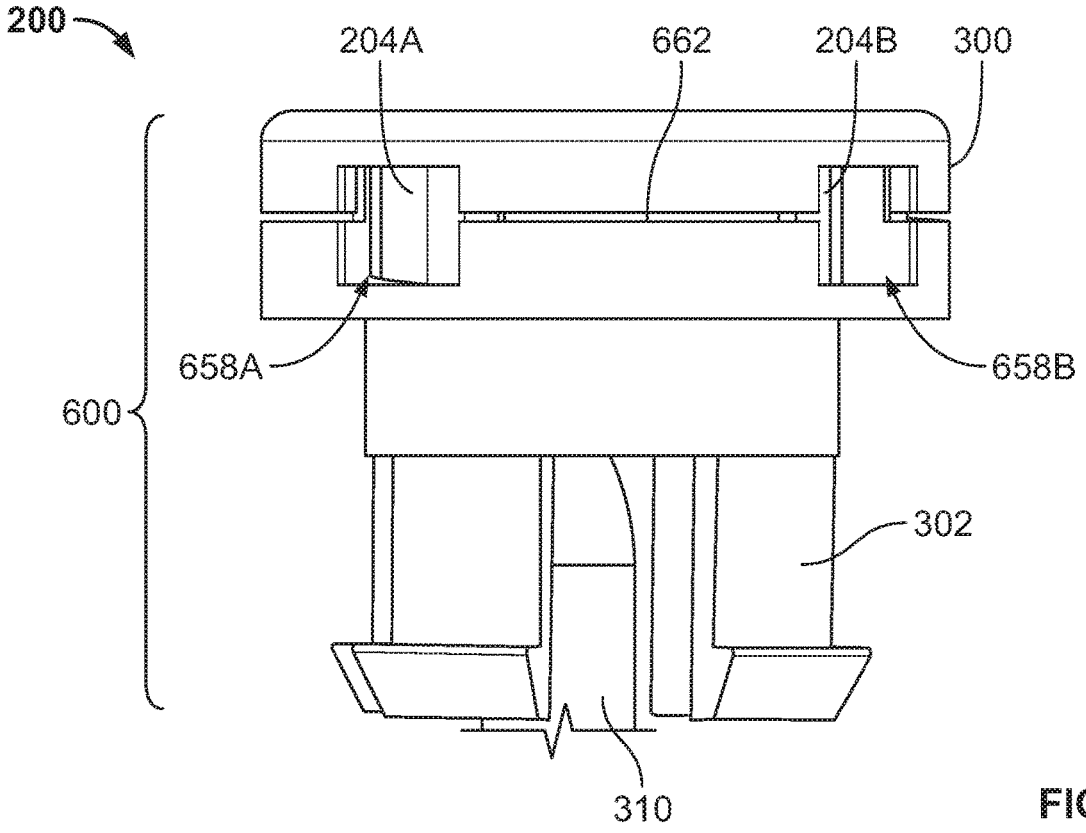
FIG. 6A shows a side view of an example acoustic apparatus in accordance with an embodiment.

FIG. 6A shows a side view of the acoustic apparatus 200 in an assembled state, in accordance with an embodiment. The acoustic apparatus 200 includes a protective housing 600. In certain instances, the protective housing 600 may be formed from an upper protective housing 300 and a lower protective housing 302. The upper protective housing 300 and the lower protective housing 302 may be integral and formed of a single piece, or the upper protective housing 300 and the lower protective housing 302 may be separate portions that are configured to integrate and couple together.

Figure 6B:
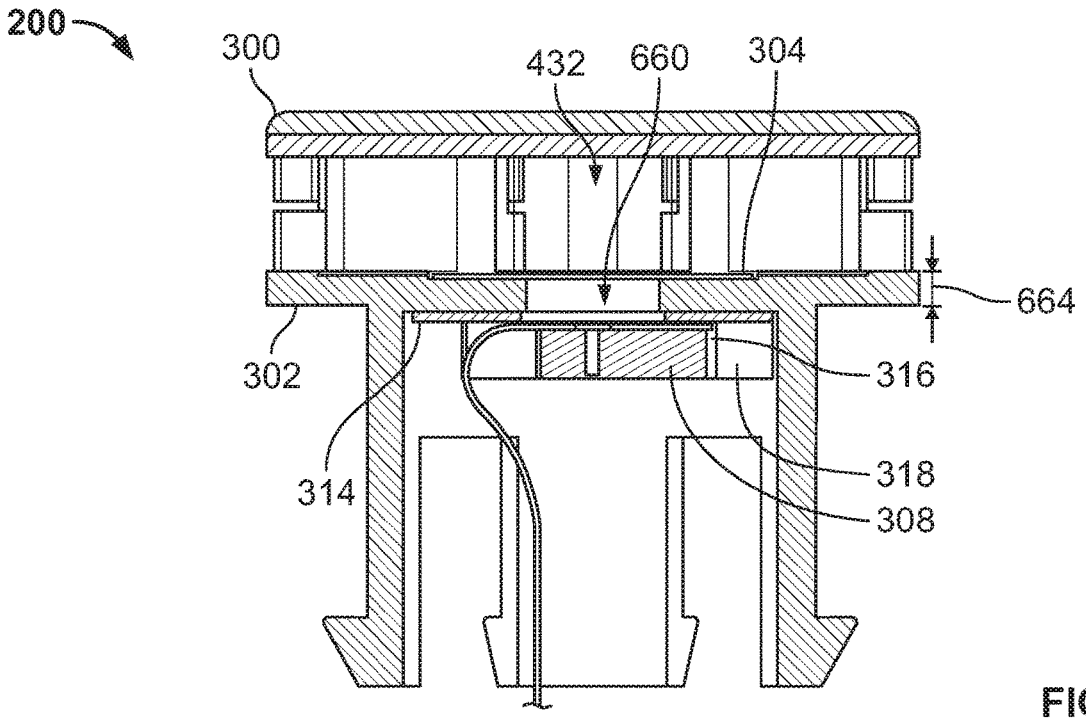
FIG. 6B shows a partial cut-away view of the acoustic apparatus, shown in FIG. 6A, in accordance with an embodiment.

FIG. 6B shows a partial cut-away view of the acoustic apparatus 200, shown in FIG. 6A, in accordance with an embodiment. As shown in FIG. 6B, the acoustic apparatus 200 also includes a membrane 304 and an electronic component 306. In certain instances, the acoustic apparatus 200 may include multiple membranes 304 and/or multiple electronic components 306. The multiple membranes 304 may be stacked on top of one another and coupled together or adhered together. In addition, the multiple electronic components 306 may be stacked, arranged in parallel, or arranged in an array within the acoustic apparatus 200. In certain instances, the protective housing 600 is configured to protect the membrane 304 and electronic component 306 from a water spray test. In addition and as shown in FIG. 6B, the protective housing 600 is configured to exhibit a 0.5 dB-20 dB insertion loss in the frequency range from 300 Hz to 5 kHz. In certain instances, the protective housing 600 exhibits a 0.5 dB-3 dB or a 0.5 dB-6 dB insertion loss in the frequency range from 300 Hz to 5 kHz. In certain instances, the protective housing 600 exhibits a 0.5 dB-20 dB, a 0.5 dB-3 dB or a 0.5 dB-6 dB insertion loss in the frequency range from 300 Hz to 10 kHz. As one example, the protective housing 600 with vanes 204*a-d* were found to provide wind noise protection in the range of a 0.5 dB-6 dB insertion loss in the frequency range from 300 Hz to 5 kHz when exposed to wind speeds of approximately 15 Kilometers per hour ("KPH") as compared a protective housing 600 without vanes 204*a-d*. As another example, the protective housing 600 with vanes 204*a-d* were found to provide wind noise protection in the range of a 0.5 dB-6 dB insertion loss in the frequency range from 300 Hz to 10 kHz when exposed to wind speeds of approximately 15 KPH as compared a protective housing 600 without vanes 204*a-d*. The protective housing 600 was placed directly outside a wind tunnel in this example testing.

In certain instances, the frequency range may be 300 Hz to 3 kHz for these insertion losses. In some instances, a high level of attenuation may be desirable (e.g., up to 20 dB) such as in noisy environments where a microphone may have difficulty processing high pressures (e.g., passive attenuation). The acoustic gap 660 may be sized to exhibit a 0.5 dB-20 dB insertion loss in the frequency range from 300 Hz to 5 kHz. The acoustic gap 660 may also be sized to exhibit a 0.5 dB-20 dB insertion loss in the frequency range from 300 Hz to 10 kHz. As a result, the acoustic gap 660 does not audibly degrade the acoustic performance of the membrane 304 and the electronic component 306.

As referenced, the electronic component may be a microelectromechanical systems (MEMS) microphone 308 coupled to a flex circuit 310 that may be arranged within the protective housing 300, 302. The microphone 308 (or other electronic components such as sensors, acoustic transducers) may be integrated into the acoustic apparatus 200 after manufacture of the acoustic apparatus 200. For example, an end user of the acoustic apparatus 200 may insert the microphone 308 (or other electronic components such as sensors, acoustic transducers) into the acoustic apparatus 200 prior to use.

The acoustic gap 660 may be arranged between the MEMS microphone 308 and the acoustic membrane 304. The acoustic gap 660 may be between 1 mm and 15 mm, in certain instances, and may include a volume (e.g., 0.8 $mm^3$-30 $mm^3$) that has 0.5 dB-20 dB insertion loss in the target frequency range (e.g., from 300 Hz to 5 kHz, from 300 Hz to 10 kHz, among others). In certain instances, a length (and volume) of the acoustic gap 660 may be modified to accommodate certain situations or installations. The length may be increased by extending an interior length 664 of the lower protective housing 302. The membrane 304 may be adhesively secured, heat welded, laser welded, ultrasonically welded, or otherwise coupled to the lower protective housing 302, for example. In addition, the acoustic gap 660 behind the membrane 304 is sealed. In addition, the acoustic apparatus 200 may include a gasket 314 arranged between the lower protective housing 302 and the electronic component 306. The gasket 314, and membrane 304, may equalize the atmospheric pressure within the gap 660. In certain instances, a protective structure (e.g., polytetrafluoroethylene (PTFE), polytetrafluoroethylene expanded (ePTFE), a woven fiber structure such as cotton fiber, a foam such polyurethane foam, a polyester woven material, porous metal, or other similar structures) may fill the interior 432 between the vanes 204*a-d*. The protective structure may be configured to enhance wind noise and/or spray protection performance of the acoustic apparatus 200. In addition or alternatively to the protective structure being arranged within the interior 432, the protective structure may be wrapped about an external surface 662 of the protective housing 600. For example, the protective structure may be a sheet of material wrapped about or covering the external surface 662 of the protective housing 600. The protective structure may be configured to enhance wind noise and/or spray protection performance of the acoustic apparatus 200.

In certain instances, the protective housing 600 includes indirect pathways 452 (shown in FIG. 4C) extending from the external surface 662 of the protective housing 600 toward an interior 432 of the protective housing 600. In addition and as discussed in detail above, the housing 600 may be configured to protect the membrane 304 and electronic component 306 from a water spray test and allow the acoustic signal to excite the acoustic membrane 304 without noticeable degradation of the acoustic signal. In certain instances, the water spray test may be ISO 20653 IPx6K spray test. This test is performed using a water jet nozzle with 6.3 mm diameter, at a distance of 2.5-3.0 meters from the device being tested, with a flow rate of 75 L/min at a water pressure of approximately 1000 kPa for 3 minutes. In addition, the ISO 20653 test may be ISO 20653 IPx9K spray test that is performed using a fan jet nozzle at a distance of 100 to 150 mm from the device being tested (which is on a rotating turntable at 5 rpm) at angles of 0, 30, 60, and 90 degrees, with a flow rate of 15 L/min at a water pressure of approximately 8000 to 10000 kPa at 80 degrees C. for 30 seconds at each of the four angles.

The housing 600 may also protect against environmental elements by removing energy from atomized water particles that are under pressure while permitting the gap 660 to remain at or near atmospheric pressure. The housing 600 and, in particular the indirect pathways 452, being configured in this manner may facilitate protection of the membrane 304 without noticeable degradation of the acoustic signal.

Openings 658*a-b* in the protective housing 600 provide an entry point for the indirect pathways and for the environmental elements and acoustic signal or signal to enter the protective housing 600. The openings 658*a-b* (formed by openings 422*a-d* in the upper protective housing 300 and lower openings 540*a-d* in the lower protective housing 302 aligned with the openings 422*a-d* in the upper protective housing 300) may be an entry point for the indirect pathways 452 (shown in FIG. 4C) formed by the protective housing 600 and the vanes 204*a-d*.

The openings 658*a-b* may be equal in number to the vanes 204*a-d*. In certain instances, the vanes 204*a-d* are aligned with the openings 658*a-b*. The vanes 204*a-d* are configured to direct the environmental elements (e.g., wind, water spray, particulate, or other contaminants) away from the membrane 304 arranged within the protective housing 600. The vanes 204*a-d* are arranged to prevent direct impingement of environmental elements (e.g., water spray) on the membrane 304. In certain instances, the openings 658*a-b* are the only access point for environmental elements to enter the protective housing 600. Thus, the environmental elements (e.g., wind, water spray, particulate, or other contaminants) directly contact the vanes 204*a-d* upon entry into the protective housing 600.

Figure 6C:
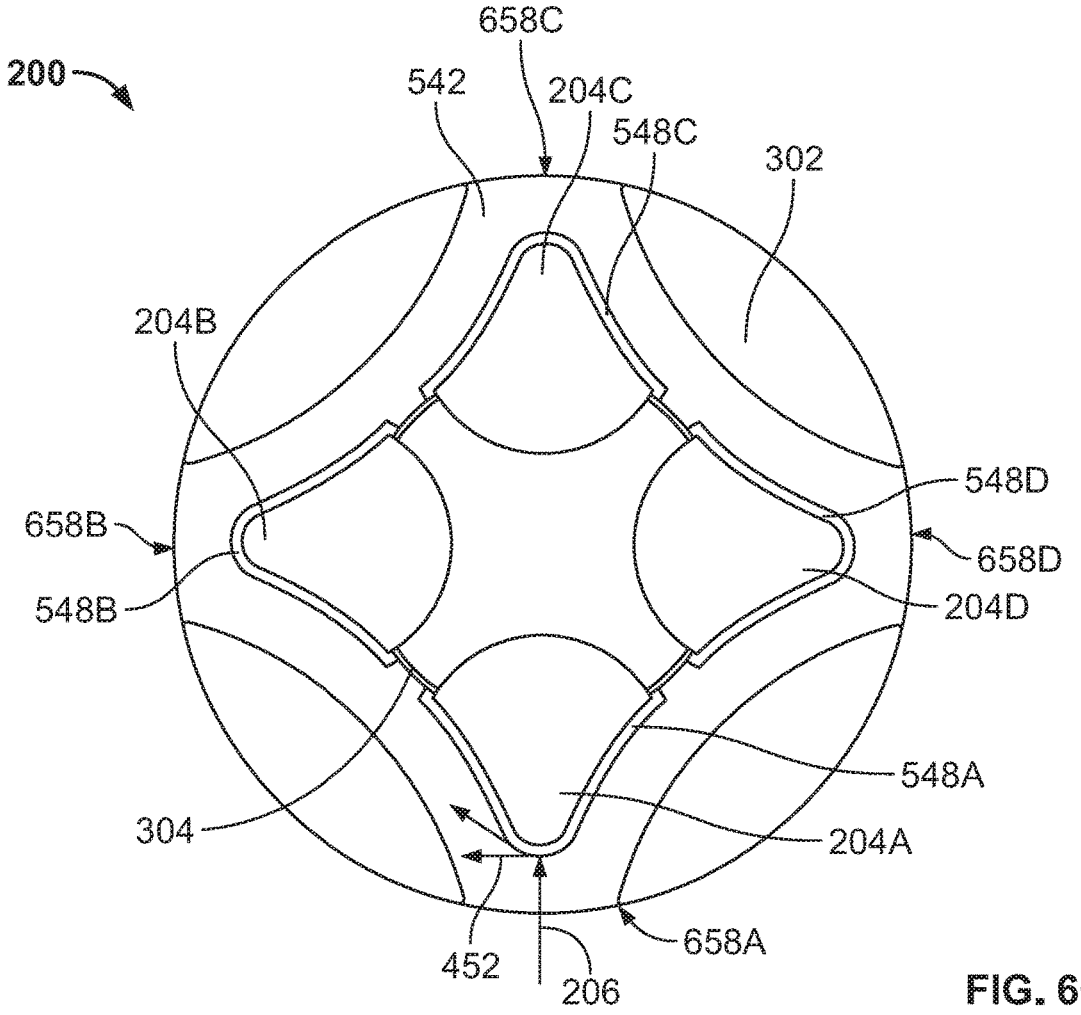
FIG. 6C shows a horizontal cross section view of the acoustic apparatus, shown in FIG. 6A-B, in accordance with an embodiment.

FIG. 6C shows a horizontal cross section view of the acoustic apparatus 200, shown in FIG. 6A-B, in accordance with an embodiment. As shown in FIG. 6C, the vanes 204*a-d* form indirect pathways 452 for flow 206 of environmental elements and acoustic signals. As noted above, one openings 658*a-d* are present in the acoustic apparatus 200 in order for acoustic signals to transmit into the acoustic apparatus 200. This also allows for environmental elements to potentially flow into the acoustic apparatus 200. The vanes 204*a-d* are aligned with the openings 658*a-b* to form the indirect pathways 452 for flow 206 of environmental elements and acoustic signals. The vanes 204*a-d* are configured to direct the environmental elements (e.g., water spray) away from the membrane 304 arranged within the protective housing 600. The vanes 204*a-d* are arranged to prevent direct impingement of environmental elements (e.g., water spray) on the membrane 304.

As noted above, the first recessed portion 548*a-d* of the lower protective housing 302 may bound the vanes 204*a-d* and may be configured to facilitate integration between the upper protective housing 300 (not shown in FIG. 6C) and the lower protective housing 302. The surface 542 of the lower protective housing 302 may be a flow surface for the environmental elements to be directed about one or more of the vanes 204*a-d*.

In certain instances, the protective housing 600 is arranged external to a cabin of a vehicle as shown in FIG. 1. The protective housing 600 may be laser welded, snap-fit, ultrasonically welded, adhered, surface mounted, or otherwise coupled to the vehicle. In order to test efficacy of the protective housing 600, a water spray test may be utilized (e.g., ISO 20653). The electronic component 306 is configured to facilitate interaction with the vehicle. Interaction with the vehicle may include audibly communicating without noticeable degradation of the acoustic signal. Communicating the acoustic signal can includes a user speaking to command the autonomous vehicle. An owner or other individual may wish to issue voice commands or prompts to the vehicle when the owner or other individual is external to the vehicle. This may include commanding or prompting the vehicle to lock, start, or perform another function. In addition, the electronic component 306 may also sense other sounds external to the vehicle (e.g., emergency vehicle sirens, oncoming traffic, or others) and react accordingly.

As the term is used herein, "gasket" and derivations thereof shall mean a material having properties of absorbing or reflecting sound and vibration wave energy when compressed between two surfaces to form a seal. The gasket can be used in a conventional manner between a transducer/MEM microphone and a housing surface, or between surfaces within a housing, to acoustically isolate and dampen vibrations in selected areas.

The protective housing discussed herein may be injection-molded. Vulcanizable plastics, such as silicones or natural rubber, and thermoplastics, such as polypropylene, polyethylene, polycarbonates or polyamides, as well as preferably thermoplastic elastomers, like Santoprene™. or Hytrel™. All these plastics can be used in the so-called insert molding injection-molding process, which offers the significant advantage that it is possible to injection-mold the protective housing to the membrane 304 in one work process. The thermoplastic elastomers can combine the properties of being able to be processed in the insert molding injection-molding process and preserving their elastomer properties in so doing. In addition, the protective housing may be formed of a hydrophobic or hydrophilic material or may include a hydrophobic or hydrophilic coating. The hydrophilic material or coating facilitates draining of water by, for example being configured to allow water to stick to the vanes (formed of the hydrophilic material or having a hydrophilic coating) such that water does not run into and onto the membrane. The hydrophobic material or coating facilitates repelling of water by, for example, the vanes (formed of the hydrophobic material or having a hydrophilic coating) repelling water such that the water does not run into and onto the membrane. The hydrophobic or hydrophilic materials or a hydrophobic or hydrophilic coatings may be fluoropolymer-based.

The membrane discussed herein may be formed of a number of materials. The protective housing (e.g., acoustic gap and arrangement of the electronic element and membrane) are configured to maintain acoustic performance without noticeable degradation or attenuation of the acoustic signal. The membrane 304 may be configured to protect against wind noise and/or other environmental elements, with the arrangement of the protective housing 300, 302 facilitating a higher signal-to-noise ratio along with improved sound quality. The membrane 304 may be formed of a fluoropolymer, PTFE, ePTFE membrane, nylon, silicone, polyvinylidene fluoride (PVDF) membrane, or any of combination thereof or any other similar materials. In addition, the membrane 304 may have an oleophobic treatment. For example, the membrane 304 may include a porous ePTFE membrane with oleophobic treatment in accordance with U.S. Pat. No. 5,376,441, manufactured by W. L. Gore & Associates, Inc.

The invention of this application has been described above both generically and with regard to specific embodiments. It will be apparent to those skilled in the art that various modifications and variations can be made in the embodiments without departing from the scope of the disclosure. Thus, it is intended that the embodiments cover the modifications and variations of this invention provided they come within the scope of the appended claims and their equivalents.

What is claimed is:

1. An acoustic apparatus, comprising:

an acoustic membrane;

a protective housing defining an interior space in which the acoustic membrane is received, the protective housing including indirect pathways extending from outside the protective housing into the interior space of the protective housing to allow acoustic energy from outside the protective housing into the interior space and to the acoustic membrane and the protective housing forming an acoustic gap configured to provide, in combination with the acoustic membrane, a 0.5 dB-20 dB insertion loss in the frequency range from 300 Hz to 5 kHz; and a microphone configured with the acoustic membrane to sense an acoustic signal and arranged within the interior space, wherein the protective housing defines the interior space in which the microphone and the acoustic membrane are received such that the acoustic membrane protects the microphone from exposure to water.

2. The acoustic apparatus of claim 1, wherein the protective housing includes an upper protective housing and a lower protective housing and the acoustic membrane is arranged between the upper protective housing and the lower protective housing and the microphone is arranged within the lower protective housing and the upper protective housing includes one or more openings along an external surface and one or more vanes aligned with the one or more openings, wherein the one or more openings and the one or more vanes form the indirect pathways, and wherein the one or more vanes are configured to direct water spray away from the acoustic membrane.

3. The acoustic apparatus of claim 2, wherein each of the one or more vanes include a curved surface facing the one or more openings and second and third surfaces extending from the curved surface expanding a width of the one or more vanes.

4. The acoustic apparatus of claim 2, further comprising a protective structure that is at least one of wrapped about the external surface of the protective housing and arranged within the interior space of the protective housing, the protective structure being configured to enhance at least one of wind noise and spray protection performance.

5. The acoustic apparatus of claim 2, wherein the upper protective housing and the lower protective housing are configured to interface, and the lower protective housing includes one or more lower openings that are aligned with the openings in the upper protective housing.

6. The acoustic apparatus of claim 5, wherein a first surface of the one or more vanes interfaces with a first surface of the lower protective housing.

7. The acoustic apparatus of claim 6, wherein the first surface of the one or more vanes includes a recessed portion relative to the first surface of the one or more vanes, and the first surface of the one or more vanes is configured to bound the acoustic membrane.

8. The acoustic apparatus of claim 7, wherein the first surface of the lower protective housing includes a first recessed portion and a second recessed portion, and the first recessed portion of the lower protective housing is configured to bound the first surface of the one or more vanes and the second recessed portion of the lower protective housing is configured to bound the acoustic membrane.

9. The acoustic apparatus of claim 2, wherein each of the one or more vanes includes straight surfaces.

10. The acoustic apparatus of claim 1, wherein the microphone is a microelectromechanical systems (MEMS) microphone coupled to a flex circuit arranged within the protective housing.

11. The acoustic apparatus of claim 10, wherein the protective housing includes the acoustic gap between the microelectromechanical systems (MEMS) microphone and the acoustic membrane.

12. The acoustic apparatus of claim 1, wherein the protective housing is configured to exhibit a 0.5 dB-3 dB insertion loss in the frequency range from 300 Hz to 5 kHz.

13. The acoustic apparatus of claim 1, wherein the protective housing is arranged external to a cabin of a vehicle; and the microphone is configured to facilitate interaction with the vehicle.

14. The acoustic apparatus of claim 1, wherein the protective housing is configured to comply with at least one of: International Standard 20653 or International Standard 16750-4 for road vehicles.

* * * * *